US010059501B2

(12) United States Patent
Bogenrief

(10) Patent No.: US 10,059,501 B2
(45) Date of Patent: Aug. 28, 2018

(54) PENETRATING BOTTLE WITH HIGH HEAT TRANSFER RATE

(71) Applicant: James Bogenrief, Moorepark, CA (US)

(72) Inventor: James Bogenrief, Moorepark, CA (US)

( * ) Notice: Subject to any disclaimer, the term of this patent is extended or adjusted under 35 U.S.C. 154(b) by 0 days.

(21) Appl. No.: 15/200,970

(22) Filed: Jul. 1, 2016

(65) Prior Publication Data

US 2017/0107042 A1 Apr. 20, 2017

Related U.S. Application Data

(60) Provisional application No. 62/243,623, filed on Oct. 19, 2015.

(51) Int. Cl.

| | |
|---|---|
| ***B65D 1/06*** | (2006.01) |
| ***B65D 23/00*** | (2006.01) |
| ***B65D 41/04*** | (2006.01) |
| ***B65D 81/18*** | (2006.01) |
| ***B65D 1/02*** | (2006.01) |
| ***B65D 41/02*** | (2006.01) |

(52) U.S. Cl.

CPC ..... *B65D 81/18* (2013.01); *B65D 1/0246* (2013.01); *B65D 1/0261* (2013.01); *B65D 41/02* (2013.01)

(58) Field of Classification Search

CPC .. B65D 2501/009; B65D 1/06; B65D 1/0261; B65D 1/0284

USPC ..... 215/2; 220/631, 623, 608

See application file for complete search history.

(56) References Cited

U.S. PATENT DOCUMENTS

| | | | | | |
|---|---|---|---|---|---|
| 639,881 | A * | 12/1899 | Paterson | A47G 19/12 | 222/470 |
| 1,724,378 | A * | 8/1929 | Stokstad | B67D 1/0079 | 137/453 |
| 3,124,264 | A * | 3/1964 | Waisberg | B65D 1/06 | 215/2 |
| 4,544,077 | A * | 10/1985 | Rucker | A45F 3/18 | 215/12.1 |
| 6,105,812 | A * | 8/2000 | Riordan | B65D 1/04 | 215/6 |
| 6,488,171 | B1 * | 12/2002 | Diveley | B65D 1/18 | 220/571 |
| 9,439,551 | B1 * | 9/2016 | Atkinson | B05B 11/3014 | |

(Continued)

FOREIGN PATENT DOCUMENTS

FR 966989 A * 10/1950 ..... B65D 1/06

*Primary Examiner* — J. Gregory Pickett
*Assistant Examiner* — Allan Stevens
(74) *Attorney, Agent, or Firm* — Gary L. Eastman, Esq.; Eastman & McCartney LLP

(57) ABSTRACT

The quick penetration bottle having high heat transfer rate has a tip, base, body, shoulder, neck, mouth and cap. The small frontal surface area of the tip allows a user to apply a minimal amount of force to the bottle to create a large amount of pressure to penetrate a medium, such as ice, and the sloped face of the base directs the medium around the body. The material used is thermally conductive and the shape of the bottle achieves a high rate of heat transfer due to the high surface area to volume ratio. The cap has low thermal conductivity minimizing the rate of heat transfer through the cap. The base and body of the bottle is submerged into a medium with a lower temperature with only the cap exposed to the environment allowing the thermal properties of the bottle to reduce the temperature of the contents within.

15 Claims, 7 Drawing Sheets

(56) References Cited

U.S. PATENT DOCUMENTS

| | | | | |
|---|---|---|---|---|
| 2006/0102580 | A1* | 5/2006 | Betras | B65D 1/06 215/6 |
| 2006/0186144 | A1* | 8/2006 | Tinsley | B05B 11/0037 222/377 |
| 2008/0230505 | A1* | 9/2008 | Kerman | B65D 41/0471 215/44 |
| 2009/0008414 | A1* | 1/2009 | Tingsley | B05B 11/0037 222/377 |
| 2014/0008318 | A1* | 1/2014 | Proctor | B65D 39/00 215/200 |
| 2015/0060453 | A1* | 3/2015 | Rahimi | A23G 1/505 220/265 |

* cited by examiner

PENETRATING BOTTLE WITH HIGH HEAT TRANSFER RATE

RELATED APPLICATIONS

This application claims the benefit of priority to the United States Provisional Patent Application for "Penetrating Bottle with High Heat Transfer Rate", Ser. No. 62/243,623, filed on Oct. 19, 2015.

FIELD OF INVENTION

The present invention relates generally to the field of bottles. The present invention is more particularly, though not exclusively, a penetrating bottle with high heat transfer rate with the ability to easily penetrate a cooling medium and quickly cool down a liquid stored within the bottle.

BACKGROUND OF INVENTION

Bottles are used to store a variety of liquids from water to alcoholic beverages to coffee. Bottles provide easy portability and storage of liquids and come in a variety of different sizes. Although variations exist, most bottles have the same general shape. They have a large base extending into a body and tapering into a shoulder and then into a neck with an opening often referred to as a mouth. Additionally, most bottles have a reusable cap to cover the mouth of the neck to allow consumers to open the cap and enjoy the contents and close the cap to reserve the rest for later. Other bottles, such as those in wine and champagne bottles have one time use caps where the cap is not meant to be reused. Although bottles afford the consumer a reliable container in which they are able to store their desired liquids, the current design of bottles has certain disadvantages.

One particular example is cooling bottles used to store beverages and the beverages contained within. The majority of bottled beverages are consumed chilled or at a low temperature. To achieve the desired low temperature of the beverage, consumers have placed their bottles inside refrigerators to cool down the beverage. However, once they remove the bottle from the refrigerator, the bottle is exposed to the environment and the temperature begins to rise as heat transfer between the environment, the bottle, and the beverage occur. Consumers then have a choice to either put the bottle back in the refrigerator or leave the bottle out. Most of the time, consumers leave the bottle out as access to a refrigerator is not always available and may not be conveniently accessed such as when holding a private event at a hall, an event at a beach, sitting by the poolside, or barbecuing in the backyard. As an alternative to refrigeration, consumers often resort to use of ice chest or ice buckets to keep their drinks cool.

Ice chest or ice buckets provides consumers with access to a portable cooling apparatus which helps keep the bottled beverages cold. Due to the shape and size of typical bottles, the typical bottle presents several challenges to using an ice chest or ice bucket. For example, in order to keep the bottle cold, the bottle must be in direct contact with the ice. Indeed, in order to keep the bottle and its contents cool, the bottle must be reinserted into the ice contained in the ice chest or bucket. Typically, the design of a bottle is optimized to enable the bottle to carry the largest volume of liquid while having the smallest surface area. This design approach most often results in a cylindrical bottle with a large base and body. However, this shape results in a minimal surface area of the bottle. This minimal surface area to volume ratio reduces the efficiency of the heat transfer required to cool down the bottle or keep the bottle and its contents cool.

Due to the large base, inserting the bottles by the base is very difficult. The large surface area of the base exerts the force being applied to the bottle in a large area, making it difficult and requiring more force to put the bottle into the ice chest or ice bucket. The neck and mouth portion has a smaller area and it is possible to insert the bottle top side first. By inserting the top side first, the force is concentrated on the cap and mouth portion of the bottle which requires less overall force to insert the bottle. However, the neck portion does not contain a large volume of liquid and thus reduces the overall heat transfer rate of the entire volume of liquid in the bottle. Additionally, by putting the bottle upside down, you are putting the bottle at risk for leaking. After opening a bottle, it is common for a cap to be incorrectly put back on. People may not have closed their caps tight enough, or in cases of wine and champagne bottles, the caps cannot be easily reinserted. This will lead to the beverage leaking, particularly if the contents of the bottle are under pressure such as champagne. Inserting a traditional bottle by the tope is not desirable for these reasons.

In light of the above, it would be advantageous to provide a bottle to store beverages having high heat transfer rate with the ability to be easily inserted into a medium such as ice. It would further be advantageous to provide a beverage bottle having a narrow tip to allow easy insertion into a medium. It would further be advantageous to provide a bottle with a surface area to volume ratio optimized to promote the efficient heat transfer between the liquid contained in the bottle and its surroundings. It would further be advantageous to provide a beverage container with a cap having a large surface area in which the bottle may stably rest. It would further be advantageous for the cap to be made of low thermally conductive material to minimize the heat transfer through the cap between the beverage within the bottle and the environment and to prevent condensation forming on the cap. It would further be advantageous to provide a cap sized to allow a user to easily grip and handle the bottle by the cap.

SUMMARY OF INVENTION

A preferred embodiment of the Penetrating Bottle with High Heat Transfer Rate of the present invention is a bottle for storing liquid having high heat transfer rate with the ability to be easily inserted into a cooling medium such as ice. The bottle of the present invention is integrally formed and has a tip, body, base, shoulder, neck, and mouth, sealable with a cap. The tip is integrally formed with and encloses one end of the body and the base is integrally formed with and partially encloses the opposite end. The shoulder extends from the base and is formed with the neck having a mouth, providing an opening to the interior of the bottle. The exterior of the neck is threaded and corresponding threads are formed into the interior of the cap. The cap is screwed onto the neck to create a tight, leak-proof seal. The cap provides a large surface area on which the bottle may stand vertically upright in a stable manner. The penetrating bottle of the present invention is oriented atypical from a typical bottle. When placed on a base surface, the Penetrating Bottle with High Heat Transfer Rate is set on its cap and with the tip pointing up.

To allow maximum heat transfer between the liquid within the bottle and the environment, the thermal conductivity of the bottle is maximized. Thermal conductivity is the property of a material to conduct heat and is a function of area, thickness and the thermal conductivity of the material used. The higher the thermal conductivity, the higher the heat transfer rate will be. Therefore, to maximize the thermal conductivity of the bottle, the surface area is maximized and the thickness kept to a minimum. In a preferred embodiment, the material is glass to provide the thermal conductivity desired as well as the strength and durability to withstand normal use. Along with maximizing the surface area for thermal conductivity, the surface area must be maximized to store the desired volume enclosed by the bottle. Larger volumes require more time to cool as compared to small volumes. The dimensions of the bottle are optimized to store the desired volume of liquid while providing the greatest surface area resulting in a surface area to volume ratio of at least 0.80.

Due to its shape, a user can apply a minimal amount of force to the bottle to create a large amount of pressure. The total force applied to the bottle will be concentrated and applied at the tip as it penetrates the bucket of ice. The small size of the tip will force its way into crevices between the ice and the pressure exerted by the tip will force the ice to part. Additionally, the angle of the base is at a slope and the slope aids the penetration of the bottle into the ice as it directs the ice cubes away from the tip and around the bottle. By having a smooth transition from the tip to the body, there are no protruding elements to hinder the bottle from entering the ice.

In a preferred embodiment, the bottle is fully submerged into a bucket of ice with only the cap exposed to the environment in order to take advantage of the thermal characteristics of the bottle. The cap thermally insulates the body from the environment due to its low thermal conductivity and minimizes the rate of heat transfer through the cap. This allows the liquid within the bottle to remain cooler. The size of the cap is made large to keep thermal conductivity low and to provide a large enough area enough to allow a user to easily grip and handle the bottle by the cap. Due to its insulating nature, the amount of condensation of the cap is minimized, allowing for a dry surface to grip.

BRIEF DESCRIPTION OF FIGURES

The novel features of this invention, as well as the invention itself, both as to its structure and its operation, will be best understood from the accompanying drawings, taken in conjunction with the accompanying description, in which reference characters refer to similar parts, and in which.

DETAILED DESCRIPTION OF FIGURES

Figure 1:
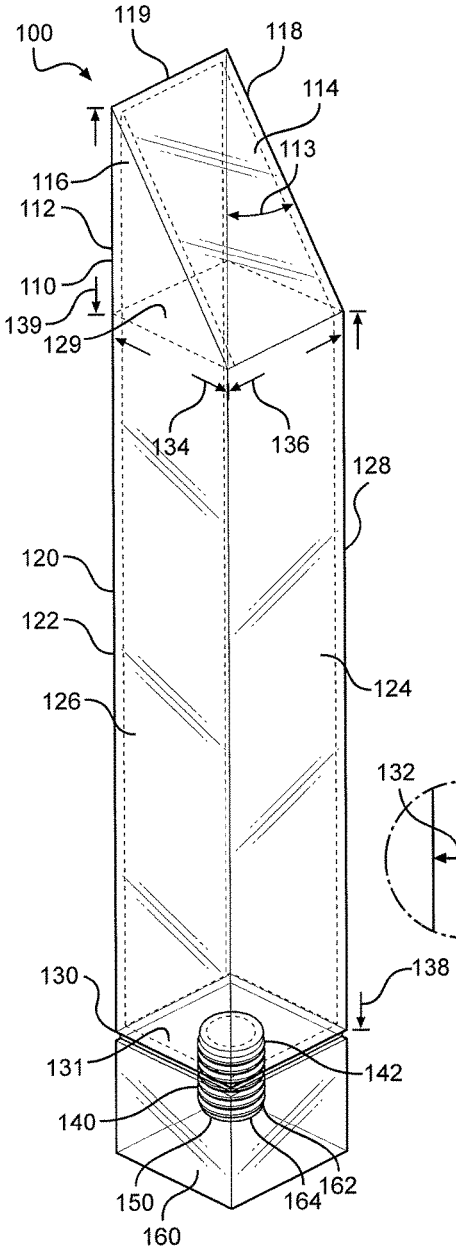
FIG. 1 is a top perspective view of the bottle showing the base with a narrow tip pointing vertically upwards while the bottle is resting on the cap.

Initially referring to FIG. 1, a preferred embodiment of the Penetrating Bottle with High Heat Transfer Rate of the present invention is shown and generally designated 100. The Penetrating Bottle with High Heat Transfer Rate 100 is integrally formed as a single piece and comprises a body 120 formed with a tip 110 fully enclosing one end of the body 120 and a base 130 is integrally formed with and partially encloses the opposite end of body 120. A shoulder 131 extends from the base 130 and is formed with a neck 140 having a mouth 150, providing an opening to the interior of the Penetrating Bottle with High Heat Transfer Rate 100. The exterior of the neck 140 is threaded with male threads 142 and corresponding female threads 162 are formed into the interior of a cap 160. The cap 160 is screwed onto the neck 140 to create a tight, leak-proof seal. The cap 160 provides a large surface area on which the Penetrating Bottle with High Heat Transfer Rate 100 may stand vertically upright in a stable manner.

As shown in the preferred embodiment of FIG. 1, the cap 160 is attached to the neck 140 through the use of male threads 142 and female threads 162. The cap 160 has female threads 162 on the interior of the cap whereas the neck 140 has male threads 142 formed on the exterior of the neck 140. The male threads 142 and female threads 162 correspond to one another and the cap 160 seals the mouth 150 to create a tight, waterproof fit when threaded together. The use of male threads 142 and female threads 162 as a means of attaching cap 160 to the neck 140 is not meant to be limiting. It is known in the art other methods of attaching a cap 160 to a neck 140 is possible, such as with a friction fit or other mechanical fits.

The neck 140 is integrally formed into the shoulder 131 of the Penetrating Bottle with High Heat Transfer Rate 100. The shoulder 131 provides a surface in which cap 160 rests when fully threaded onto the neck 140. The mouth 150 is an opening integrally formed in the center of neck 140, extending through the neck 140 and shoulder 131 into the body 120. The mouth 150 provides an opening for the contents of the Penetrating Bottle with High Heat Transfer Rate 100 to be inserted or removed.

The shoulder 131 is integrally formed with the body 120, with neck 140 pointing away from the body 120. The body 120 includes a rear wall 122, a front wall 124, a right wall 126 and a left wall 128 having the same dimensions and thickness 132, vertically extended and rigidly connected together at orthogonal angles to create a square cross-section 129.

Thermal conductivity is the property of a material to conduct heat and is a function of area, thickness, and thermal conductivity of the material used. The higher the thermal conductivity, the higher the heat transfer rate will be. Therefore, to maximize the thermal conductivity of the bottle, the surface area is maximized and the thickness 132 kept to a minimum. In the preferred embodiment, the material is glass to provide the thermal conductivity desired as well as the strength and durability to withstand normal use. The use of glass is not meant to be limiting. It is known by those skilled in the art, alternative materials having the desired thermal conductivity and strength exists and may be used. For instance, other materials may be used, including but not limited to metallic materials such as aluminum.

Along with maximizing the surface area for thermal conductivity, the surface area must be maximized to store the desired volume enclosed by the bottle. Larger volumes require more time to cool down compared to small volumes. As a result, the surface area to volume ratio must be optimized. Thus, each wall has the same length 134, width 136, height 138, and thickness 132 and is all predetermined to provide the greatest amount of surface area while maintaining the ability to store the desired amount of volume, resulting in an optimized surface area to volume ratio specific to the volume enclosed, the desired heat transfer rate, and the shape of the bottle. The surface area of the Penetrating Bottle with High Heat Transfer Rate 100 allows the liquid contained within to be cooled at a higher rate compared with typical bottles by optimizing the surface area to volume ratio and the thermal conductivity of the bottle. The resulting high heat transfer rate of the Penetrating Bottle with High Heat Transfer Rate 100 allows the liquid within the bottle to be cooled in a short amount of time.

The shoulder 131 encloses one end of the body 120 and the opposite end is enclosed by the tip 110. This creates an enclosed container with a single opening at the mouth 150. In the preferred embodiment of FIG. 1, the tip 110 is in the shape of a triangular prism made of an adjacent wall 112, a hypotenuse wall 114, a right triangular wall 116, and a left triangular wall 118. The adjacent wall 112 is adjacent to and runs parallel and in the same plane as the rear wall 122 of the body 120. The hypotenuse wall 114 is formed at an acute angle 113 to adjacent wall 112. By forming the adjacent wall 112 and hypotenuse wall 114 at an acute angle 113, it provides a point 119 with a small frontal surface area. The point 119 is able to apply a large amount of force to a small area, making it easier to penetrate a medium such as cubed ice.

Due to its small frontal surface area, a user can apply a minimal amount of force to the Penetrating Bottle with High Heat Transfer Rate 100 to create a large amount of pressure, a measure of the force applied to a given area at the point 119. The total force applied to the Penetrating Bottle with High Heat Transfer Rate 100 will be concentrated and applied at the point 119 as it penetrates a bucket of ice cubes. The point 119 will force its way into crevices between the ice cubes and the pressure exerted by the point 119 will force the individual ice cubes apart. Additionally, the angle 113 between the adjacent wall 112 and hypotenuse wall 114 creates a slope at which the hypotenuse wall 114 is oriented. The slope aids the Penetrating Bottle with High Heat Transfer Rate 100 get deeper into the bucket of ice cubes as it directs the ice cubes away from the tip 110 and along the hypotenuse wall 114, which is a smooth surface extending form the point 119 to the body 120. By having a smooth transition from the point 119 to the body 120, there are no protruding elements to hinder the Penetrating Bottle with High Heat Transfer Rate 100 from entering the bucket of ice cubes.

Compared to a blunt object such as the base of a traditional bottle, the tip 110 is easier to insert into a medium such as ice due to the large amount of pressure it is able to create and the ability of the hypotenuse wall 114 to smoothly direct the ice around the Penetrating Bottle with High Heat Transfer Rate 100. The typical bottle has a large base, limiting the amount of pressure that can be created for a given force applied. Because the surface area of the base of a typical bottle is large, the force applied to the bottle will be applied to a larger area producing less pressure to penetrate the ice. Additionally, the large surface area prevents the bottle from penetrating seams or crevices between the ice. Instead, the typical bottle is shifted and maneuvered to push aside the ice, requiring large amounts of force and effort.

As shown in the preferred embodiment, the cap 160 is attached to the neck 140 through the use of male threads 142 and female threads 162. The cap 160 serves to close off the mouth 140 as well as act as a thermal barrier between the Penetrating Bottle with High Heat Transfer Rate 100 and the external environment. The cap 160 is made from a low-thermally conductive material such as a type of hard plastic or other materials known in the art with low-thermal conductivity. To further minimize the amount of thermal conductivity, the cap 160 is a large solid cube with the same cross-section as cross-section 129. A threaded hole 164 is formed in the center of the cap 160. The female threads 162 of the threaded hole 164 correspond with the male threads 142 on the neck 140.

Unlike the tip 110, the body 120, the shoulder 131 and the neck 140, the cap 160 is made of material with low thermal conductivity. The size of the cap 160 is made large to keep thermal conductivity low as thermal conductivity is a function of area, thickness and thermal conductivity of the material. When the tip 110 and the body 120 is fully submerged into a bucket of ice to maximize the heat transfer of Penetrating Bottle with High Heat Transfer Rate 100, the cap 160 is left exposed to allow a user to easily grip and handle the bottle by the cap 160. The cap 160 thermally insulates the tip 110 and the body 120 from the environment due to its low thermal conductivity, minimizing heat transfer through the cap. This allows the liquid within the Penetrating Bottle with High Heat Transfer Rate 100 to remain cold. The amount of condensation on the cap 160 is minimized, allowing for a dry surface to grip.

Due to the design of the tip 110, the Penetrating Bottle with High Heat Transfer Rate 100 cannot be placed in the traditional orientation with the neck 140 pointed vertically upward and the cap 160 exposed and where the tip 110 is placed onto a hard surface and supports the Penetrating Bottle with High Heat Transfer Rate 100. The tip 110 does not provide a stable surface in which it may be supported. Thus, when not placed in an ice bucket, the Penetrating Bottle with High Heat Transfer Rate 100 rests on the cap 160. The large surface area of the cap 160 stabilizes and allows the Penetrating Bottle with High Heat Transfer Rate 100 to stand on the cap 160 without worry of it tipping over.

In an exemplary example, the preferred embodiment of the present invention the Penetrating Bottle with High Thermal Transfer Rate 100 has predetermined dimensions optimized to achieve the highest heat transfer rate by maximizing the surface area for thermal conductivity and to store the desired volume enclosed by the bottle. The optimized surface area to volume ratio of Penetrating Bottle with High Heat Transfer Rate 100 for the industry standard volume of 750 ml for alcoholic beverages is at least 0.85. As a result, the body 120 integrally formed with the base 130 and shoulder 131 has width 134 of 5.25 cm, length 136 of 5.25 cm, and height 138 of 25 cm. The tip 110 has width 134 of 5.25 cm, length 136 of 5.25 cm, and height 139 of 7 cm. This results in approximately 672 $cm^2$ of total surface area with a capacity to hold 785 $cm^3$ of total volume. The extra 35 $cm^3$ of area serves as headspace, in instances where the increased pressure caused by expansion of the liquid due to heating or freezing could cause the container to break. In comparison, the surface area to volume ratio of standard sized liquor bottles holding 750 ml is 0.67-0.70. A preferred embodiment of the Penetrating Bottle with High Heat Transfer Rate 100 has a greater surface area to volume ratio over standard sized liquor bottles. Indeed, in some cases, the ratio is at least 17% greater than standard sized bottles.

Figure 2:
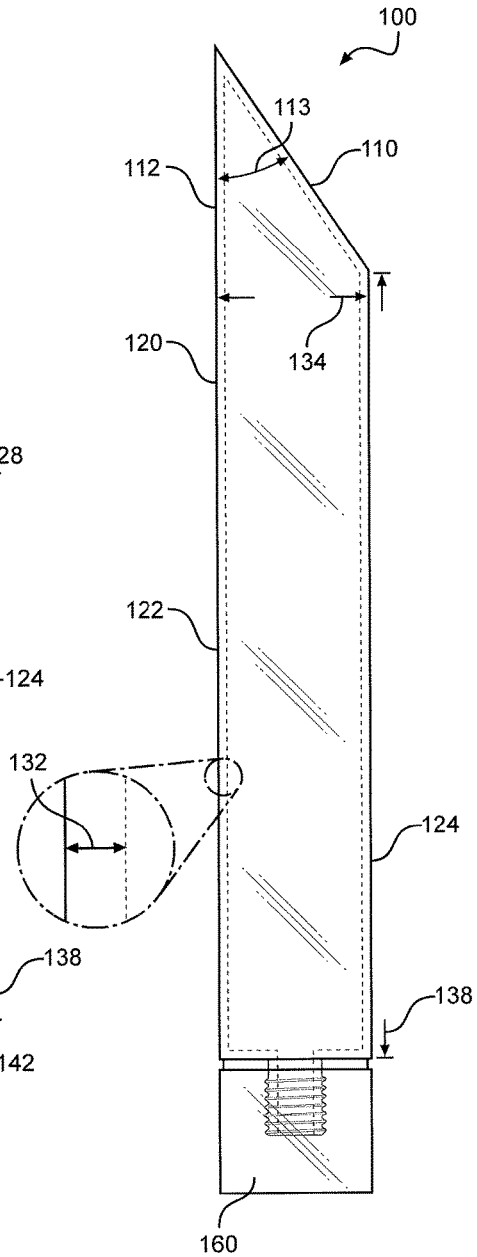
FIG. 2 is a right side view of the present invention showing the easy insertion top and bottle cap bottom.

Referring now to FIG. 2, a right side view of the present invention shows the Penetrating Bottle with High Heat Transfer Rate 100 resting on the cap 160 with tip 110 pointing upwards. The Penetrating Bottle with High Heat Transfer Rate 100 is integrally formed as a single piece. The adjacent wall 112 of the tip 110 is a linear extension of the rear wall 122 of the body 120. At the edge of the adjacent wall 112, the hypotenuse wall 114 is integrally formed at an acute angle 113 forming the point 119. The hypotenuse wall 114 extends from the point 119 to the edge of the front wall 124 of the body 120. As shown, the tip 110, the body 120, the base 130, and the shoulder 131 have predetermined thickness 132 to optimize the thermal characteristics of the Penetrating Bottle with High Heat Transfer Rate 100.

As shown, the Penetrating Bottle with High Heat Transfer Rate 100 is placed on the cap 160, atypical of the placement of a typical bottle. As a triangular prism, the tip 110 does not provide a flat surface for the bottle to be placed in the typical manner. As a result, the cap 160 is made to provide a flat stable surface in which the bottle may be placed upon to rest. The cap 160 has the same cross-section 129 as the body 120.

Figure 3:
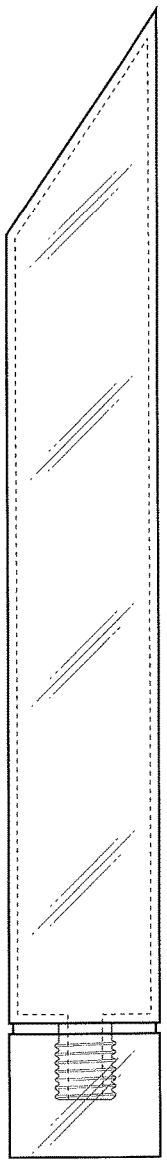
FIG. 3 is a left side view of the present invention showing the easy insertion top and bottle cap bottom.

Referring now to FIG. 3 is a left side view of the present invention showing the Penetrating Bottle with High Heat Transfer Rate 100 resting on the cap 160 with tip 110 pointing upwards. As shown, the left side is a mirror image of the right side of the Penetrating Bottle with High Heat Transfer Rate 100.

Figure 4:
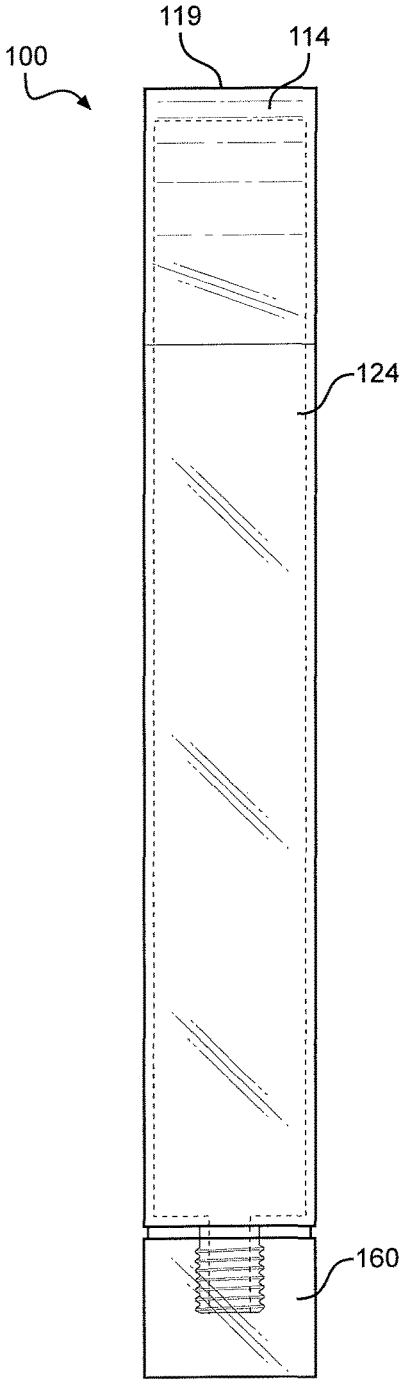
FIG. 4 is a front view of the bottle showing a rectangular outline of the bottle.

Referring now to FIG. 4 is a front view of the Penetrating Bottle with High Heat Transfer Rate 100. As shown, the hypotenuse wall 114 extends from the point 119 to the front wall 124 at a slope with acute angle 113.

Figure 5:
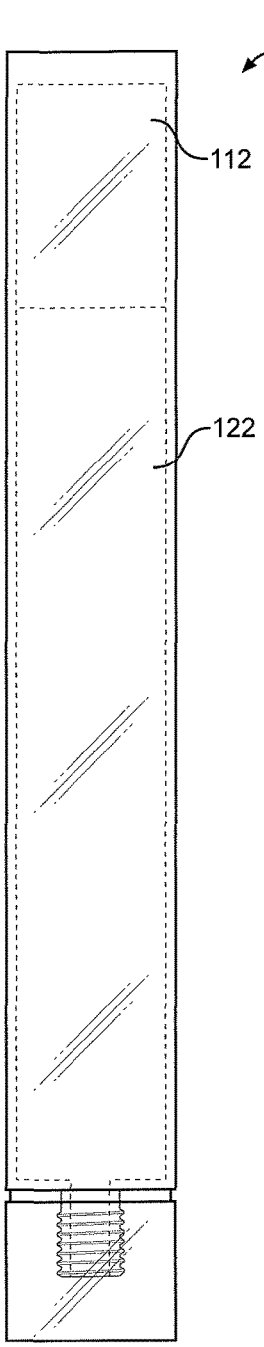
FIG. 5 is the rear view of the bottle showing a rectangular outline of the bottle.

Referring now to FIG. 5 is a rear view of the Penetrating Bottle with High Heat Transfer Rate 100 showing the adjacent wall 112 integrally formed with rear wall 122.

Figure 6:
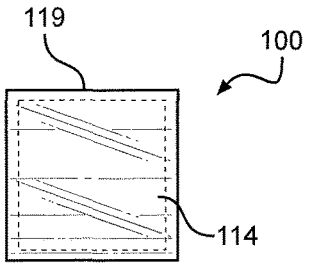
FIG. 6 is the top view of the bottle showing the small front surface area of the tip.

Referring now to FIG. 6 is the top view of the Penetrating Bottle with High Heat Transfer Rate 100 showing the tip 110 integrally formed with the body 120. As shown, the hypotenuse wall 114 extends from the point 119 to the front wall 124 at a slope with acute angle 113 (not shown in this figure). Due to its small frontal surface area, a user can apply a minimal amount of force to the Penetrating Bottle with High Heat Transfer Rate 100 to create a large amount of pressure at the point 119. The point 119 will force its way into crevices between ice cubes and the pressure exerted by the point 119 will force the individual ice cubes apart.

Figure 7:
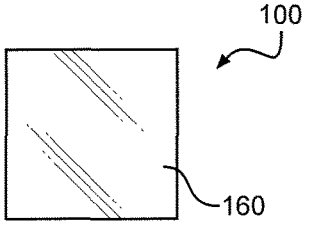
FIG. 7 is the bottom view of the bottle showing the cap having the same cross-section as the body of the bottle.

Referring now to FIG. 7, a bottom view of the Penetrating Bottle with High Heat Transfer Rate 100 shows the cap 160. As shown, the cross-section of the cap 160 is similar in size to the cross-section 129. As a result, the center of gravity of the bottle is located substantially in the center of the body 120 which projects through the center of the cap 160. The cross-section of the cap 160 is wide enough to support the Penetrating Bottle with High Heat Transfer Rate 100 in its upward position in a stable manner.

Figure 8:
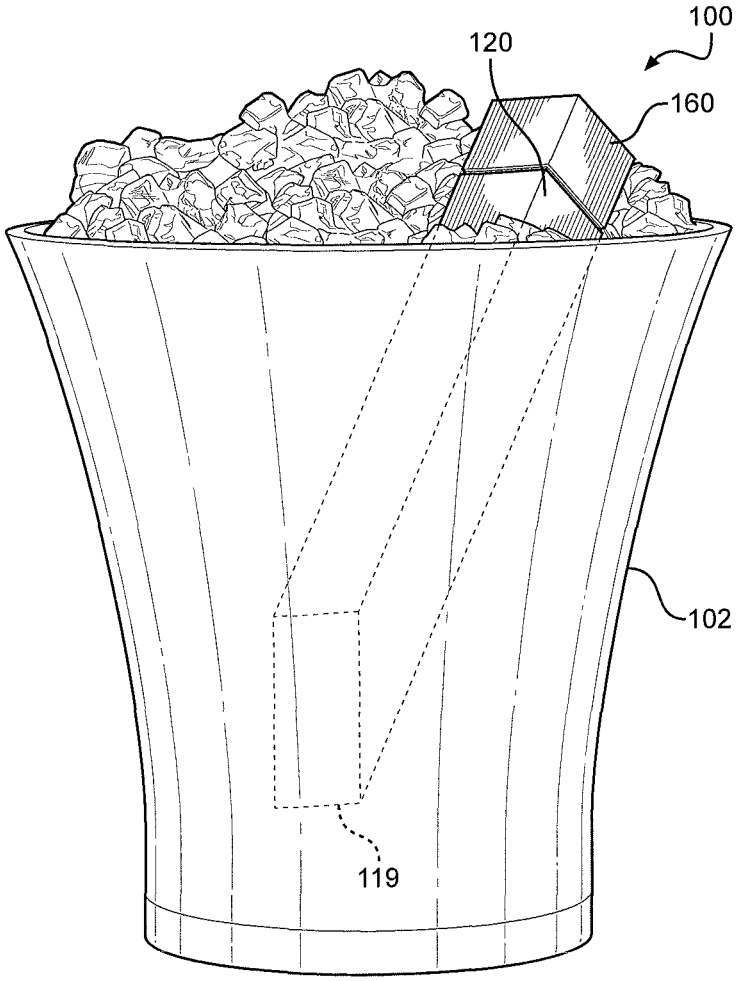
FIG. 8 is a perspective view of the bottle submerged into a bucket of ice with the cap fully exposed and a small portion of the body exposed.

Referring now to FIG. 8, the Penetrating Bottle with High Heat Transfer Rate 100 is shown placed within an ice bucket 102 filled with ice cubes with a small portion of the body 120 exposed and the cap 160 fully exposed. The quick penetration bottle with high heat transfer rate 100 is inserted into the ice bucket 102 tip 110 first. The point 119 of the tip 110 allows the Penetrating Bottle with High Heat Transfer Rate 100 to be easily inserted into the ice bucket 102 with minimal force.

The Penetrating Bottle with High Heat Transfer Rate 100 is fully submerged into a bucket of ice with only the cap exposed to the environment in order to take advantage of its thermal characteristics. The cap 160 thermally insulates the body 120 from the environment due to its low thermal conductivity, reducing the heat transfer through the cap 160. This allows the liquid within the Penetrating Bottle with High Heat Transfer Rate 100 to remain cold. The size of the cap 160 is sized to keep thermal conductivity low and to provide a large enough area to allow a user to easily grip and handle the bottle by the cap 160. Due to its insulating nature, the amount of condensation of the cap 160 is minimized, allowing a dry surface to grip.

Referring now to FIGS. 9A-D, the process of inserting the Penetrating Bottle with High Heat Transfer Rate 100 into a bucket of ice is disclosed. FIGS. 9A-D is a side view of a cutaway of an ice bucket 102 with ice 104, showing various stages of the Penetrating Bottle with High Thermal Transfer Rate 100 being inserted into the ice bucket 102.

Figure 9A:
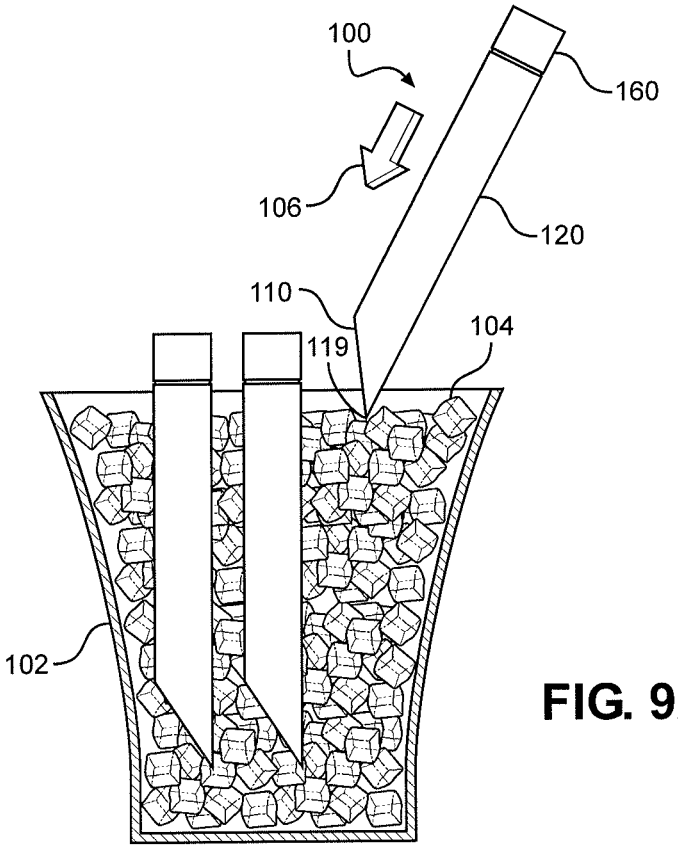
FIGS. 9A, 9B, 9C, and 9D shows the process of inserting the bottle into a bucket of ice.

FIG. 9A shows two bottles already inserted into an ice bucket 102 filled with ice 104 and a third bottle in the process of being inserted. The last bottle being inserted is held by the cap 160 over the ice bucket 102 and directed into the ice bucket 102 in direction 106. Tip 110 is directed towards the ice bucket 102 with the point 119 being configured to be the first to contact the ice 104. The point 119 is able to apply a large amount of force to a small area, making it easier to penetrate the ice 104. The angled surface of the tip 110 aides the penetration into ice 104 as it directs the ice 104 away from the tip 110 and along the surface area of the Penetrating Bottle with High Heat Transfer Rate 100.

Figure 9B:
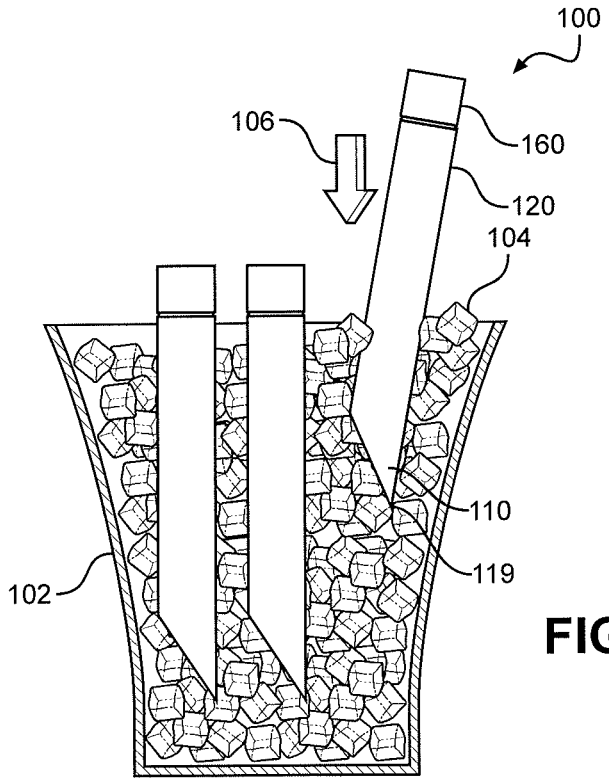

FIG. 9B shows the Penetrating Bottle with High Heat Transfer Rate 100 penetrating the ice 104. The point 119 is inserted first into ice bucket 102 and the force exerted by the person inserting the Penetrating Bottle with High Heat Transfer Rate 100 is concentrated at point 119 and the resulting pressure parts the ice 104. As the point 119 penetrates further, the angled surface of tip 110 directs the ice 104 away from the point 119 and around the tip 110. The displaced ice 104 is shifted to accommodate the Penetrating Bottle with High Heat Transfer Rate 100.

Figure 9C:
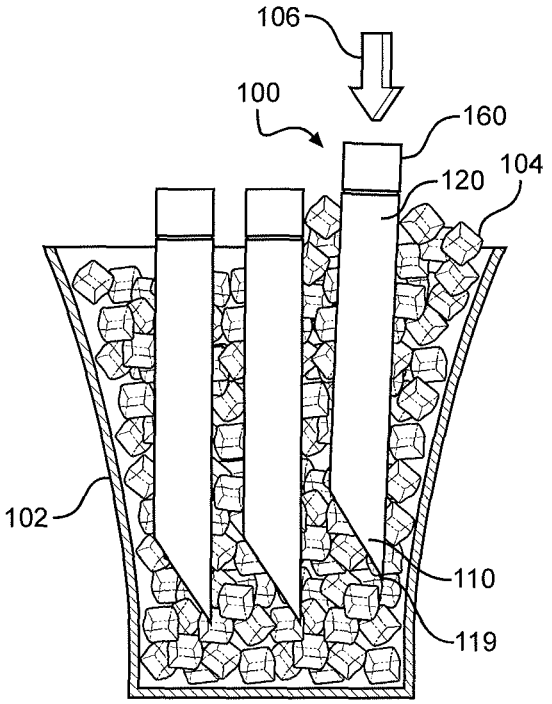
Figure 9D:
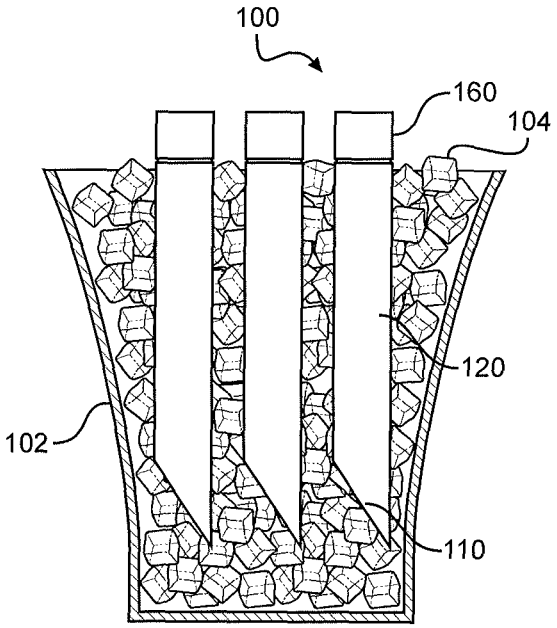

FIG. 9C shows the Penetrating Bottle with High Heat Transfer Rate 100 half submerged in the ice 104 inside the ice bucket 102. As the point 119 penetrates further, the angled surface of the tip 110 directs the ice 104 away from and around the tip 110. The displaced ice 104 is shifted to accommodate the Penetrating Bottle with High Heat Transfer Rate 100. The pressure exerted at the point 119 and the angled surface of the tip 110 allows the user to easily penetrate deeper into the ice bucket 102. As shown, as the Penetrating Bottle with High Heat Transfer Rate 100 penetrates deeper, the ice is displaced to accommodate the Penetrating Bottle with High Heat Transfer Rate 100.

FIG. 9 D shows the Penetrating Bottle with High Heat Transfer Rate 100 fully submerged in ice 104 with only the cap 160 exposed to the environment. The cap 160 thermally insulates the body 120 from the environment due to its low thermal conductivity, reducing the rate of heat transfer through the cap 160. The surface area of the body 120 and tip 110 is in direct contact with the ice 104 and heat transfer occurs. Due to the high surface area to volume ratio of the Penetrating Bottle with High Thermal Heat Transfer 100, more surface area of the volume is available to transfer heat, thus cooling the liquid faster.

Figures 10, 11, 12:
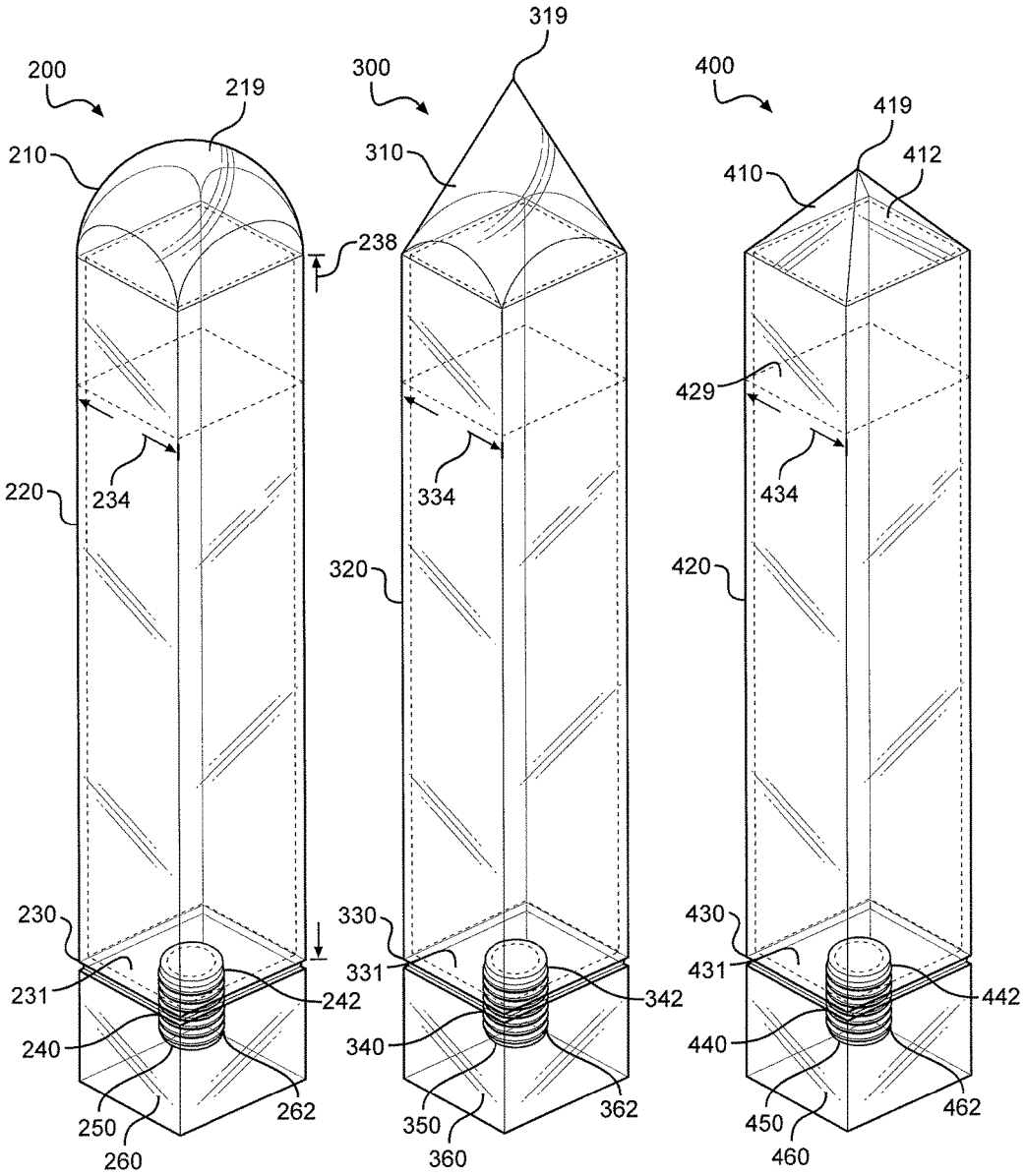
FIG. 10 is an isometric view of an alternative embodiment of the present invention showing a rectangular body with semi-sphere tip.
FIG. 11 is an isometric view of an alternative embodiment of the present invention showing a rectangular body with a conical tip.
FIG. 12 is an isometric view of an alternative embodiment of the present invention showing a rectangular body with square pyramid tip.

Referring now to FIG. 10, an isometric view of an alternative embodiment of the Penetrating Bottle with High Heat Transfer Rate of the present invention is shown and generally designated 200. The Penetrating Bottle with High Heat Transfer Rate 200 is integrally formed as a single piece and comprises a body 220 formed with a tip 210 fully enclosing one end of the body 220 with a base 230 integrally formed with and partially enclosing the opposite end of body 220. A shoulder 231 extends from a base 230, integrally formed with the body 220, and is formed with a neck 240 having a mouth 250, providing an opening to the interior of the Penetrating Bottle with High Heat Transfer Rate 200. The exterior of the neck 240 is threaded with male threads 242 and corresponding female threads 262 are formed into the interior of a cap 260. The cap 260 is screwed onto the neck 240 to create a tight, leak-proof seal. The cap 260 provides a large surface area on which the Penetrating Bottle with High Heat Transfer Rate 200 may stand vertically upright in a stable manner.

The body 220 is substantially similar to the body 120 of the preferred embodiment of the Penetrating Bottle with High Heat Transfer Rate 100 of FIG. 1. The ratio of surface area to volume is maintained to preserve the thermal conductivity and heat transfer rate substantially similar to the preferred embodiment of the present invention the Penetrating Bottle with High Heat Transfer Rate 100 shown in FIG. 1. Additionally, cap 260 serves to close the opening of the mouth 240 as well as act as a thermal barrier between the Penetrating Bottle with High Heat Transfer Rate 200 and the external environment. The cap 260 is substantially similar to cap 160 described in FIG. 1 of the preferred embodiment of the Penetrating Bottle with High Heat Transfer Rate 100.

As shown, the tip 210 of the alternative embodiment of the present invention, the Penetrating Bottle with High Heat Transfer Rate 200 is the shape of a semi-sphere. The semi-sphere is integrally formed with and encloses one end of the body 220 and has a radius equal to length 234. The apex of the semi-sphere is directed away from the body 220 and forms a point 219. The point 219 is able to apply a large amount of force to a small area, making it easier to penetrate a medium such as ice. The small size of the point 219 will force its way into crevices between ice cubes and the pressure exerted at the point 219 will force the individual ice cubes apart. Additionally, the surface of the semi-sphere creates a rounded surface area. The rounded surface area aids the penetration of the Penetrating Bottle with High Heat Transfer Rate 200 into the bucket of ice cubes as it directs the ice cubes away from the tip 210 and along the surface area of the semi-sphere, which is a smooth surface extending form the point 219 to the body 220 of the Penetrating Bottle with High Heat Transfer Rate 200.

Referring now to FIG. 11, an isometric view of an alternative embodiment of the Penetrating Bottle with High Heat Transfer Rate of the present invention is shown and generally designated 300. The Penetrating Bottle with High Heat Transfer Rate 300 is integrally formed as a single piece and comprises a body 320 formed with a tip 310 fully enclosing one end of the body 320 with a base 330 integrally formed with and partially enclosing the opposite end of base 320. A shoulder 331 extends from the base 330 and is formed with a neck 340 having a mouth 350, providing an opening to the interior of the Penetrating Bottle with High Heat Transfer Rate 300. The exterior of the neck 340 is threaded with male threads 342 and corresponding female threads 362 are formed into the interior of a cap 360. The cap 360 is screwed onto the neck 340 to create a tight, leak-proof seal. The cap 360 provides a large surface area on which the Penetrating Bottle with High Heat Transfer Rate 300 may stand vertically upright in a stable manner.

The body 320 is substantially similar to the body 120 of the preferred embodiment of the Penetrating Bottle with High Heat Transfer Rate 100 of FIG. 1. The ratio of surface area to volume is maintained to preserve the thermal conductivity and heat transfer rate substantially the same. Additionally, cap 360 serves to close the opening of the mouth 340 as well as act as a thermal barrier between the Penetrating Bottle with High Heat Transfer Rate 300 and the external environment. The cap 360 is substantially similar to cap 160 described in FIG. 1 of the preferred embodiment of the Penetrating Bottle with High Heat Transfer Rate 100.

As shown, the tip 310 of the alternative embodiment of the present invention, the Penetrating Bottle with High Heat Transfer Rate 300 has the shape of a cone. The tip 310 is integrally formed with and encloses one end of the body 320 and has a radius equal to length 334. The apex of the cone is directed away from the body 320 and forms a point 319. The point 319 is able to apply a large amount of force to a small area, making it easier to penetrate a medium such as ice. The small size of the point 319 will force its way into crevices between ice cubes and the pressure exerted by the point 319 will force the individual ice cubes apart. Additionally, the surface of the cone creates a rounded surface area. The rounded surface area aids the penetration of the Penetrating Bottle with High Heat Transfer Rate 300 into the bucket of ice cubes as it directs the ice cubes away from the tip 310 and along the surface area of the cone, which is a smooth surface extending form the point 319 to the body 320 of the Penetrating Bottle with High Heat Transfer Rate 300.

Referring now to FIG. 12, an isometric view of an alternative embodiment of the Penetrating Bottle with High Heat Transfer Rate of the present invention is shown and generally designated 400. The Penetrating Bottle with High Heat Transfer Rate 400 is integrally formed as a single piece and comprises a body 420 formed with a tip 410 fully enclosing one end of the body 420 with a base 430 integrally formed with and partially enclosing the opposite end of body 420. A shoulder 431 extends from the base 430 and is formed with a neck 440 having a mouth 450, providing an opening to the interior of the Penetrating Bottle with High Heat Transfer Rate 400. The exterior of the neck 440 is threaded with male threads 442 and corresponding female threads 462 are formed into the interior of a cap 460. The cap 460 is screwed onto the neck 440 to create a tight, leak-proof seal. The cap 460 provides a large surface area on which the Penetrating Bottle with High Heat Transfer Rate 400 may stand vertically upright in a stable manner.

The body 420 is substantially similar to the body 120 of the preferred embodiment of the Penetrating Bottle with High Heat Transfer Rate 100 of FIG. 1. The ratio of surface area to volume is maintained to preserve the thermal conductivity and heat transfer rate substantially the same. Additionally, cap 460 serves to close the opening of the mouth 340 as well as act as a thermal barrier between the Penetrating Bottle with High Heat Transfer Rate 400 and the external environment. The cap 460 is substantially similar to cap 160 described in FIG. 1 of the preferred embodiment of the Penetrating Bottle with High Heat Transfer Rate 100.

As shown, the tip 410 of the alternative embodiment of the present invention, the Penetrating Bottle with High Heat Transfer Rate 400 has the shape of a square pyramid. The tip 410 is integrally formed with and encloses one end of the body 420 and has the same cross-section as cross-section 429. The apex of the square pyramid is directed away from the body 420 and forms a point 419. The point 419 is able to apply a large amount of force to a small area, making it easier to penetrate a medium such as ice. The small size of the point 419 will force its way into crevices between ice cubes and the pressure exerted by the point 419 will force the individual ice cubes apart. Additionally, the tip 410 extends from the body 420 having cross-section 429 and tapers to the point 419 creating four angled walls 412. The four angled walls 412 aids the penetration of the Penetrating Bottle with High Heat Transfer Rate 400 into the bucket of ice cubes as it directs the ice cubes away from the tip 410 and along the angles walls 412 and away from the body 420.

Figure 13:
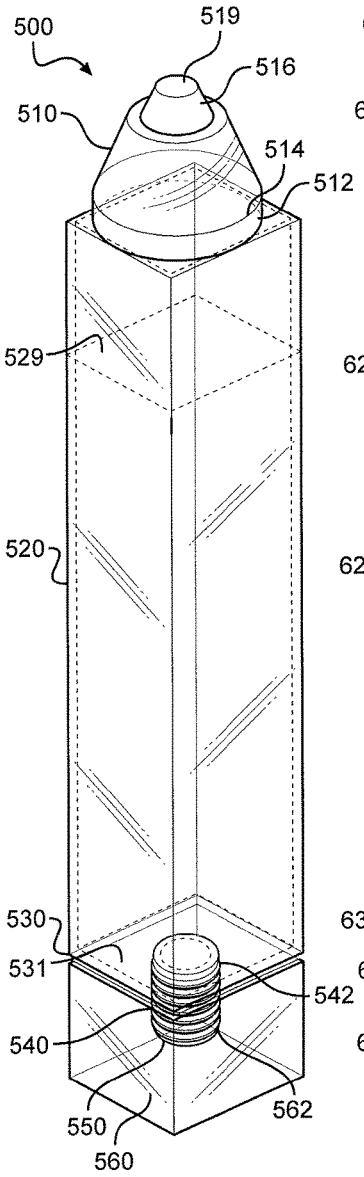
FIG. 13 is an isometric view of an alternative embodiment of the present invention showing a rectangular body with a tip made of tapering cylinders eliminating at a point.

Referring now to FIG. 13, an isometric view of an alternative embodiment of the Penetrating Bottle with High Heat Transfer Rate of the present invention is shown and generally designated 500. The Penetrating Bottle with High Heat Transfer Rate 500 is integrally formed as a single piece and comprises a body 520 formed with a tip 510 fully enclosing one end of the body 520 with a base 530 integrally formed with and partially enclosing the opposite end of body 520. A shoulder 531 extends from the base 530 and is formed with a neck 540 having a mouth 550, providing an opening to the interior of the Penetrating Bottle with High Heat Transfer Rate 500. The exterior of the neck 540 is threaded with male threads 542 and corresponding female threads 562 are formed into the interior of a cap 560. The cap 560 is screwed onto the neck 540 to create a tight, leak-proof seal. The cap 560 provides a large surface area on which the Penetrating Bottle with High Heat Transfer Rate 500 may stand vertically upright in a stable manner.

The body 520 is substantially similar to the body 120 of the preferred embodiment of the Penetrating Bottle with High Heat Transfer Rate 100 of FIG. 1. The ratio of surface area to volume is maintained to preserve the thermal conductivity and heat transfer rate substantially the same. Additionally, cap 560 serves to close the opening of the mouth 540 as well as act as a thermal barrier between the Penetrating Bottle with High Heat Transfer Rate 500 and the external environment. The cap 560 is substantially similar to cap 160 described in FIG. 1 of the preferred embodiment of the Penetrating Bottle with High Heat Transfer Rate 100.

As shown, the tip 510 of the alternative embodiment of the present invention, the Penetrating Bottle with High Heat Transfer Rate 500 is a series of cylinders with different diameters tapering to a point. The tip 510 is integrally formed with and encloses one end of the body 520. The tip 510 has a first level 512 with an initial diameter which fits within the cross-section 529. The first level 512 extends a predetermined distance and at this juncture a second level 514 with an initial diameter equal to the first level 512 extends and tapers a predetermined distance to a smaller diameter and terminates. A third level 516 with a smaller diameter than the termination of the second level 514 extends from the surface of the second level 514 and tapers to a point 519.

The point 519 is able to apply a large amount of force to a small area, making it easier to penetrate a medium such as ice. The small size of the point 519 will force its way into crevices between ice cubes and the pressure exerted by the point 519 will force the individual ice cubes apart. Additionally, the tip 510 extends from the body 520 and tapers to point 519. The angled surface area of the first level 512, the second level 514, and the third level 516 aids the penetration of the Penetrating Bottle with High Heat Transfer Rate 500 into the bucket of ice cubes as it directs the ice cubes away from the tip 510 and the body 520.

Figure 14:
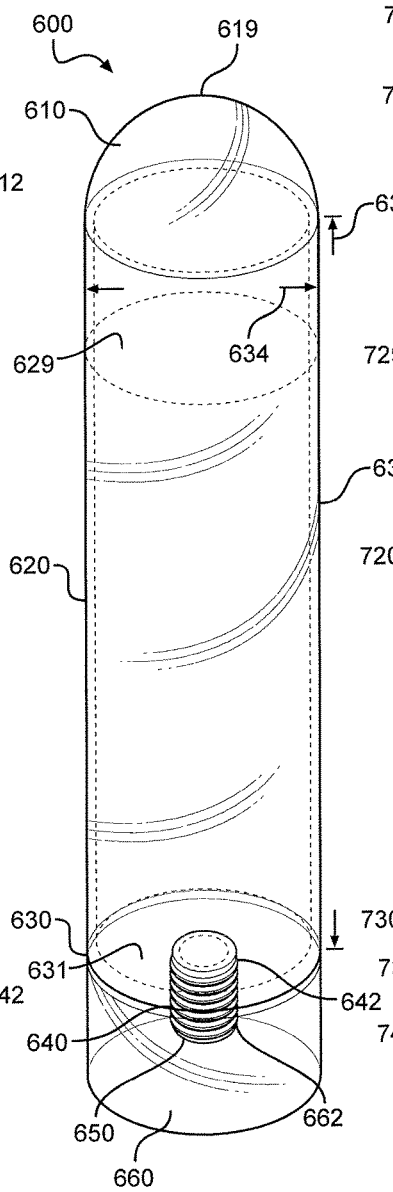
FIG. 14 is an isometric view of an alternative embodiment of the present invention showing a cylindrical body with semi-sphere tip.

Referring now to FIG. 14, an alternative embodiment of the present invention the Penetrating Bottle with High Heat Transfer Rate is shown and generally designated 600. The Penetrating Bottle with High Heat Transfer Rate 600 is integrally formed as a single piece and comprises a body 620 formed with a tip 610 fully enclosing one end of the body 620 with a base 630 integrally formed with and partially enclosing the opposite end of body 620. A shoulder 631 extends from the base 630 and is formed with a neck 640 having a mouth 650, providing an opening to the interior of the Penetrating Bottle with High Heat Transfer Rate 600. The exterior of the neck 640 is threaded with male threads 642 and corresponding female threads 662 are formed into the interior of a cap 660. The cap 660 is screwed onto the neck 640 to create a tight, leak-proof seal. The cap 660 provides a large surface area on which the Penetrating Bottle with High Heat Transfer Rate 600 may stand vertically upright in a stable manner.

The body 620 is a cylinder with a cross-section 629 having a diameter 634 and height 638. The body 620 is open ended and the wall has thickness 632. The diameter 634 and height 638 are predetermined to achieve the desired ratio of surface area to volume to preserve the thermal conductivity and heat transfer rate substantially the same as the preferred embodiment of the present invention, the Penetrating Bottle with High Heat Transfer Rate shown in FIG. 1. Cap 660 is a cylinder with the diameter equal to diameter 634. Cap 660 serves to close the opening of the mouth 240 as well as act as a thermal barrier between the Penetrating Bottle with High Heat Transfer Rate 600 and the external environment, similar to cap 160 described in FIG. 1 of the preferred embodiment of the Penetrating Bottle with High Heat Transfer Rate 100.

As shown, the tip 610 of the alternative embodiment of the present invention, the Penetrating Bottle with High Heat Transfer Rate 600 is the shape of a semi-sphere. The semi-sphere is integrally formed with and encloses one end of the body 620 and has a diameter 634. The apex of the semi-sphere is directed away from the body 620 and forms a point 619. The point 619 is able to apply a large amount of force to a small area, making it easier to penetrate a medium such as ice. The rounded surface area aids the penetration of the Penetrating Bottle with High Heat Transfer Rate 600 into the bucket of ice cubes as it directs the ice cubes away from the tip 610 and along the surface area of the semi-sphere, which is a smooth surface extending form the point 619 to the body 620 of the Penetrating Bottle with High Heat Transfer Rate 600.

Figure 15:
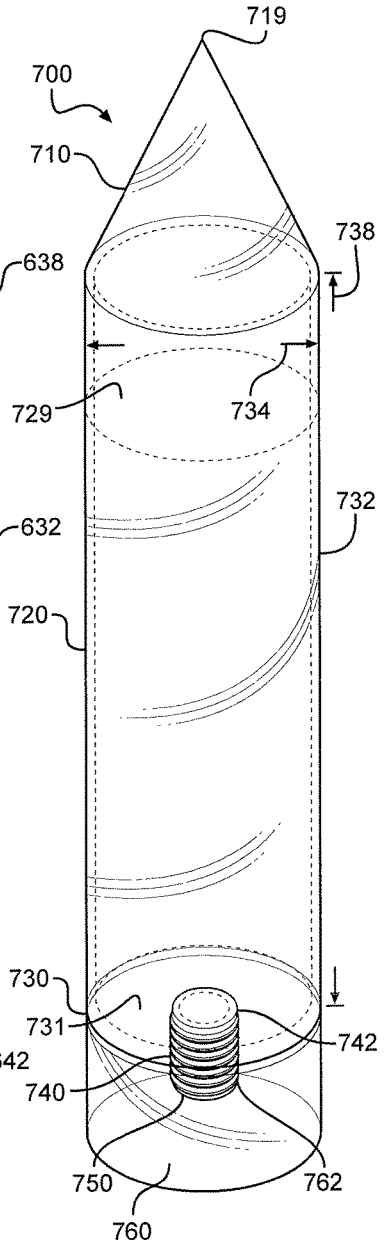
FIG. 15 is an isometric view of an alternative embodiment of the present invention showing a cylindrical body with conical tip.

Referring now to FIG. 15, an alternative embodiment of the present invention the Penetrating Bottle with High Heat Transfer Rate is shown and generally designated 700. The Penetrating Bottle with High Heat Transfer Rate 700 is integrally formed as a single piece and comprises a body 720 formed with a tip 710 fully enclosing one end of the body 720 with a base 730 integrally formed with and partially enclosing the opposite end of body 720. A shoulder 731 extends from the base 730 and is formed with a neck 740 having a mouth 750, providing an opening to the interior of the Penetrating Bottle with High Heat Transfer Rate 700. The exterior of the neck 740 is threaded with male threads 742 and corresponding female threads 762 are formed into the interior of a cap 760. The cap 760 is screwed onto the neck 740 to create a tight, leak-proof seal. The cap 760 provides a large surface area on which the Penetrating Bottle with High Heat Transfer Rate 700 may stand vertically upright in a stable manner.

The body 720 is a cylinder with a cross-section 729 having a diameter 734 and height 738. The body 720 is open ended and the wall has thickness 732. The diameter 734 and height 738 are predetermined to achieve the desired ratio of surface area to volume to preserve the thermal conductivity and heat transfer rate substantially the same as the preferred embodiment of the present invention, the Penetrating Bottle with High Heat Transfer Rate 100 shown in FIG. 1. Cap 760 is a cylinder with the diameter equal to diameter 734. Cap 760 serves to close the opening of the mouth 240 as well as act as a thermal barrier between the Penetrating Bottle with High Heat Transfer Rate 700 and the external environment, similar to cap 160 described in FIG. 1 of the preferred embodiment of the Penetrating Bottle with High Heat Transfer Rate 100.

As shown, the tip 710 of the alternative embodiment of the present invention, the Penetrating Bottle with High Heat Transfer Rate 700 is the shape of a cone. The tip 710 is integrally formed with and encloses one end of the body 720 and has a diameter equal to the diameter 729. The apex of the cone is directed away from the body 720 and forms a point 719. The point 719 is able to apply a large amount of force to a small area, making it easier to penetrate a medium such as ice. The rounded surface area aids the penetration of the Penetrating Bottle with High Heat Transfer Rate 700 into the bucket of ice cubes as it directs the ice cubes away from the tip 710 and along the surface area of the semi-sphere, which is a smooth surface extending form the point 719 to the body 720 of the Penetrating Bottle with High Heat Transfer Rate 700.

While there have been shown what are presently considered to be preferred embodiments of the present invention, it will be apparent to those skilled in the art that various changes and modifications can be made herein without departing from the scope and spirit of the invention.

The invention claimed is:

1. A container for storing liquid, comprising:

a body comprising a thermal conductivity, a square cross-section, two open ends, and four walls of equal dimensions, said walls orthogonally arranged;

a tip integrally formed and enclosing one of said open ends of said body;

a point at an end of said tip, said point having a surface area smaller than said square cross-section of said body, said point configured to direct material away from said tip and said body;

a base integrally formed and partially enclosing an other of said open ends of said body;

a shoulder integrally formed with said base;

a neck integrally formed with said shoulder having an interior and exterior surface with threads formed into the exterior surface of said neck;

a mouth integrally formed into said neck configured to provide an opening for said body; and a cap comprising a material comprising a thermal conductivity lower than said thermal conductivity of said body, said cap configured as a cover to said mouth and as a thermal barrier between an external environment and said container when said container is submerged in a medium;

whereby said body, base, shoulder and mouth are integrally formed and made of thermally conductive material and cap configured as a handle by which said container may be maneuvered, wherein said cap further comprises a solid cube with a square cross section of equal dimensions to said square cross-section of said body, said solid cube further comprising a threaded hole configured to receive said threads of said neck.

2. The container for storing liquid of claim 1, wherein said body is made from glass.

3. The container for storing liquid of claim 1, wherein said body is made from aluminum.

4. The container for storing liquid of claim 1, further comprising a surface area to volume ratio of at least 0.80 square centimeters per cubic centimeter.

5. The container for storing liquid of claim 1, wherein said cap is made from plastic.

6. The container for storing liquid of claim 1, wherein said thermal conductivity of said body is equal to the thermal conductivity of glass.

7. The container for storing liquid of claim 1, wherein said thermal conductivity of said body is greater than the thermal conductivity of glass.

8. The container for storing liquid of claim 1, wherein said tip further comprises an adjacent wall extending from and parallel to one of said walls of said body;

a hypotenuse wall formed at an acute angle to said adjacent wall;

a left triangular wall; and a right triangular wall, wherein said hypotenuse wall, adjacent wall, left triangular wall, and right triangular wall form the shape of a triangular prism.

9. A container for storing liquid, comprising:

an elongated body comprising a thermal conductivity, a square cross-section, two open ends, and a predetermined length, height, width, and thickness;

a tip integrally formed and enclosing one of said open ends of said body;

a point at an end of said tip, said point having a surface area smaller than said cross-section of said body, said point configured to direct material away from said tip and said body;

a base integrally formed and partially enclosing an other of said open ends of said body;

a shoulder integrally formed with said base;

a neck integrally formed with said shoulder having an interior and exterior surface with threads formed into the exterior surface of said neck;

a mouth integrally formed into said neck configured to provide an opening for said body; and a cap comprising a cross-section and a material comprising a thermal conductivity lower than said thermal conductivity of said body, said cap configured as a cover to said mouth and as a thermal barrier between an external environment and said container when said container is submerged in a medium, said cross-section of said cap having the similar shape and size to said cross-section of said body;

whereby said body, base, shoulder and mouth are integrally formed and made of thermally conductive material to facilitate heat transfer when said container is submerged into a medium with a lower temperature and cap configured as a handle by which said container may be maneuvered, and wherein said cap further comprises a solid cube with a square cross section of equal dimensions to said square cross-section of said body, said solid cube further comprising a threaded hole centered in said solid cube and configured to receive said threads of said neck.

10. The container for storing liquid of claim 9, wherein said body is made from glass.

11. The container for storing liquid of claim 9, wherein said body is made from aluminum.

12. The container for storing liquid of claim 9, further comprising a surface area to volume ratio of at least 0.80 square centimeters per cubic centimeter.

13. The container for storing liquid of claim 9, wherein said cap is made from plastic.

14. The container for storing liquid of claim 9, wherein said thermal conductivity of said body is equal to the thermal conductivity of glass.

15. The container for storing liquid of claim 9, wherein said thermal conductivity of said body is greater than the thermal conductivity of glass.

* * * * *